United States Patent [19]

Rickert et al.

[11] 4,255,647

[45] Mar. 10, 1981

[54] WATER TANK HAVING ELECTRIC HEATING ELEMENT AND CATHODIC CORROSION PROTECTION

[75] Inventors: Hans Rickert; Günter Holzäpfel, both of Dortmund, Fed. Rep. of Germany

[73] Assignee: Vereinigte Elektrizitätswerke Westfalen AG, Dortmund, Fed. Rep. of Germany

[21] Appl. No.: 954,424

[22] Filed: Oct. 25, 1978

Related U.S. Application Data

[63] Continuation of Ser. No. 764,903, Feb. 1, 1977, abandoned.

[30] Foreign Application Priority Data

Feb. 10, 1976 [DE] Fed. Rep. of Germany ..... 2605089

[51] Int. Cl.[3] ..... H05B 3/82; F24H 1/00; C23F 13/00

[52] U.S. Cl. ..... 219/322; 126/361; 219/312; 204/195 F; 204/196

[58] Field of Search ..... 219/322, 310, 312, 318, 219/335, 336; 204/195 F, 196, 197; 126/351, 361

[56] References Cited

U.S. PATENT DOCUMENTS

| | | | |
|---|---|---|---|
| 2,021,519 | 11/1935 | Polin | 204/196 |
| 2,934,484 | 4/1960 | Anderson | 204/196 X |
| 3,037,925 | 6/1962 | Boncher et al. | 204/196 X |
| 3,056,738 | 10/1962 | Fischer | 204/196 |
| 3,132,081 | 5/1964 | Sutton | 219/322 X |
| 3,132,082 | 5/1964 | Overmyer | 204/196 |
| 3,142,361 | 7/1964 | Woodley | 204/196 |
| 3,176,115 | 3/1965 | Balis | 219/318 |
| 3,378,472 | 4/1968 | Banks et al. | 204/196 X |
| 3,634,222 | 1/1972 | Stephens | 204/196 |
| 3,715,566 | 2/1973 | Wasson | 219/318 X |

FOREIGN PATENT DOCUMENTS

| | | | |
|---|---|---|---|
| 50-37619 | 12/1975 | Japan | 204/197 |
| 839214 | 6/1960 | United Kingdom | 219/322 |

*Primary Examiner*—A. Bartis

*Attorney, Agent, or Firm*—Toren, McGeady and Stanger

[57] ABSTRACT

An anticorrison protected small electric household water heating tank includes a metal tank having a passive anticorrosive layer provided on an inner wall thereof. A U-shaped electric immersion heating element is horizontally arranged in a lower region of the tank. A pair of electrodes are supplied with external current, one being an external current anode horizontally arranged above and perpendicular to the arms of the U-shaped heating element and the other being the tank itself. A reference electrode is also provided in the lower region of the tank. A potentiostat is connected to the reference electrode and tank for detecting the potential between the reference electrode and tank, for comparing the detected potential between tank and reference electrode to a reference voltage and for adjusting the current flow to the external electrodes to maintain an optimum potential between the tank and reference electrode. The reference electrode is of "Ag-/AgCl" and is surrounded by a flow preventing sheathing which creates a zone of stagnant water about the reference electrode. An additional anode can be provided in the upper region of the tank and the current therethrough controlled by the potentiostat.

5 Claims, 7 Drawing Figures

WATER TANK HAVING ELECTRIC HEATING ELEMENT AND CATHODIC CORROSION PROTECTION

This is a continuation of application Ser. No. 764,903, filed Feb. 1, 1977, now abandoned.

FIELD OF THE INVENTION

The invention concerns a water tank with an electric heating element arranged in its lower region and a passive anticorrosive layer provided on its inner wall and with electrodes supplied with external current, which provide the corrosion protection.

BACKGROUND OF THE PRESENT INVENTION

Hot water tanks with a small capacity, that is, particularly for household purposes, have been provided heretofore practically exclusively with a passive anticorrosive layer, mostly of enamel, as well as with a donor anode of magnesium. The magnesium anode is screwed from the top through a socket into the tank while the electric heating element is arranged above a flange in the lower part. It was found in practice that these hot water tanks are destroyed by corrosion after a few years, particularly in the lower region receiving the heat element. Thorough investigations by means of potential and current measurements showed that in these hot water tanks, the lower third is not cathodically protected is the heating flange is insulated from the boiler. The heating flange is usually not insulated for electrotechnical reasons.

The use of magnesium donor anodes has other disadvantages, in particular, magnesium anodes show considerable natural corrosion, so that they are often completely destroyed or used up after a few years. Furthermore, a considerble amount of hydrogen gas is formed on a magnesium anode which forms an oxyhydrogen gas with oxygen, which is dangerous.

For larger tanks, it has therefore been suggested to use, instead of magnesium donor anodes, electrodes supplied with external current, particularly of aluminum, ("Handbuch des kathodischen Korroisionschutzes" by Raeckmann-Schwenk, Publ. by Chemie GmbH, 1974, chapter XVI, p. 330 and 331). This did not lead, however, to a satisfactory result because the electrodes supplied with external current are always set to a single current level. Accordingly, when the conditions in the tank change, e.g., when an additional defective spot appears in the passive anticorrosive layer, the correct potential on the tank wall will no longer be set.

Besides, the present electrodes supplied with external current do not provide a solution for the problem of the special corrosion hazard in the range of the heating element of a water tank equipped with such an element. The damage in this region results from the surfaces of the heating element acting as a cathodic region in which the oxygen is reduced and can act as an oxidant. Accordingly, any defects in this region are particularly subject to corrosion in the passive anticorrosive layer.

It is also known in large objects, e.g. pipe line systems and ships ("Handbuch des kathodischen Korrosionsschutzes" chapter VI, p. 151–153), to use potentiostatically regulating d-c sources in cathodic corrosion protection within the protective systems for external current. This is done in such a way that the protective current is automatically adapted to the normal situation under changing conditions, e.g., in the pipe lines in the radius of action of d-c paths, or with the appearance of a defective spot in the passive anticorrosive layer of a ship's hull.

SUMMARY OF THE PRESENT INVENTION

The object of the invention is to provide a solution to prior art problems which brings a substantial long-term improvement in the corrosion protection of hot water tanks, particularly in the lower region having the heating element, which region is more jeopardized by corrosion.

In accordance with the present invention, a hot water tank having anticorrosion protection comprises a tank having a passive anticorrosive layer provided on an inner wall thereof, an electric heating element arranged in its lower region and electrodes supplied with external current for providing cathode corrosion protection. One of the electrodes is an external current anode arranged at the level of the heating element. Also included is a reference electrode and a potentiostat for maintaining an optimum potential for corrosion suppression between the reference electrode and tank by adjusting the current flowing between the external current electrodes.

For a better understanding of the present invention, reference is made to the following description and accompanying drawings while the scope of the invention is pointed out in the appended claims.

DESCRIPTION OF THE INVENTION

Figure 1:
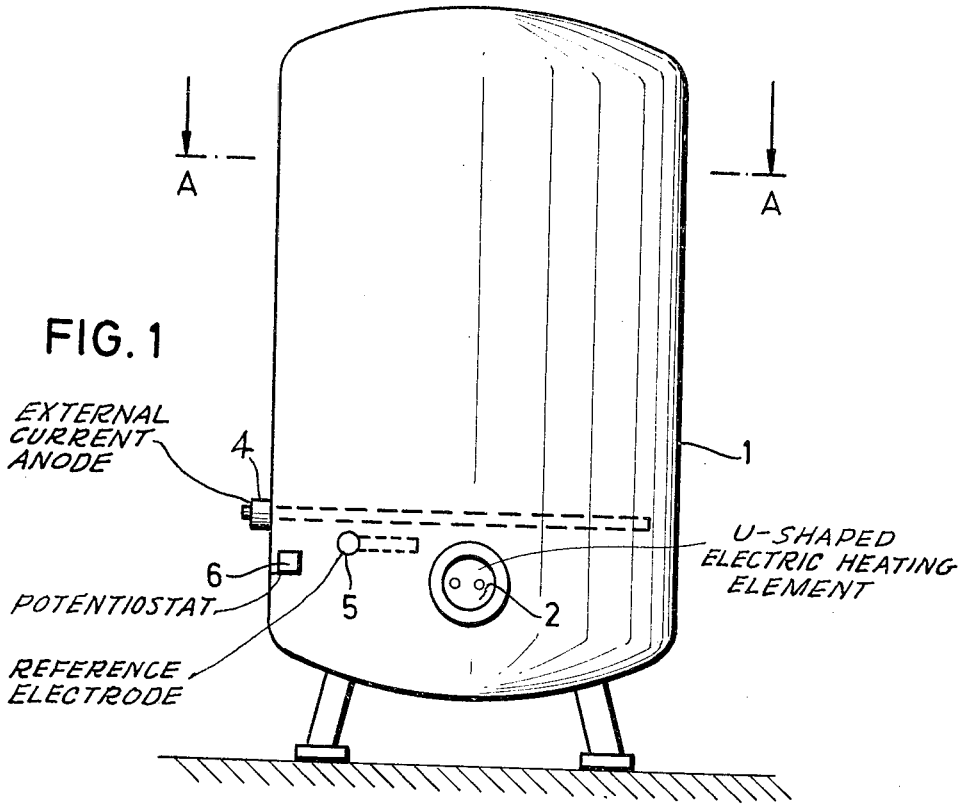
FIG. 1 is a view of a water tank according to the invention in a side elevation.
Figure 2:
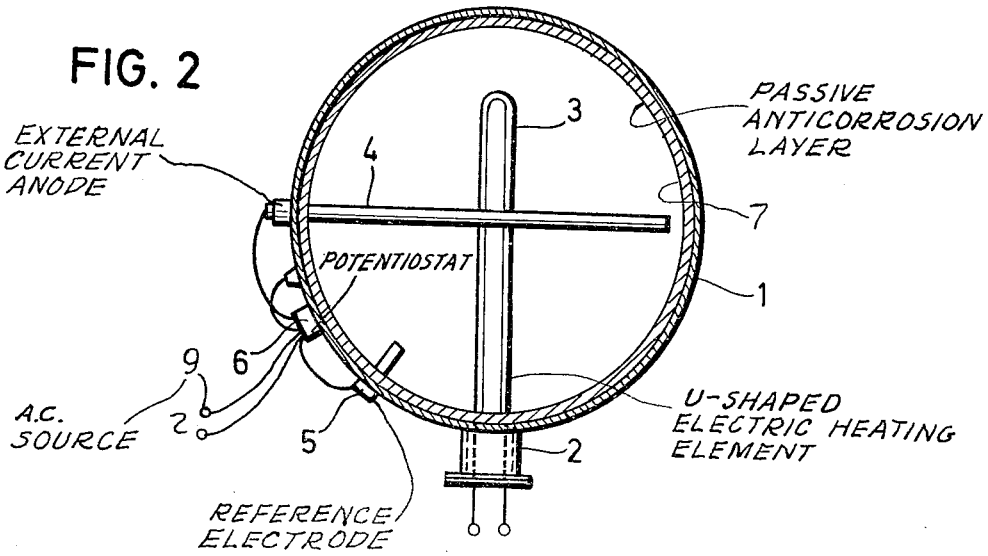
FIG. 2 is a section along the line A—A of FIG. 1.

A water tank 1 is equipped in its lower region with a heating flange 2 with a substantially U-shaped element 3, as shown in FIGS. 1 and 2. Slightly above this U-shaped heating element 3 is arranged an external current anode 4 extending perpendicularly to its arms, and arranged in an adjoining region is a reference electrode 5. The latter electrodes are both connected to a potentiostat 6 which controls, in a known manner, the optimum potential in the tank. Tank 1 and heating flange 2 are grounded here and designated as a measuring electrode, their potential relative to the reference electrode 5 being controlled by potentiostat 6. Tank 1 is provided with a passive anticorrosive layer of enamel on the inside 7 (see FIG. 2).

By a potentiostat, as mentioned above, a control device is understood having a function to keep the measuring electrode of an electrochemical cell at a constant potential, which is adjustable by means of a nominal voltage source relative to a reference electrode. To this end, the potentiostat amplifies a very small deviation of the potential of the measuring electrode from the nominal voltage, and thus regulates the current flowing through the cell between the measuring electrode and the opposing electrode.

This principle is applied to the present case of cathodic corrosion protection with external current by impressing on the subject forming the measuring electrode, namely the water tank 1, by means of potentiostat 6 and reference electrode 5, a negative potential such that corrosion is prevented and as little hydrogen as possible is formed. If the potential of tank 1 differs from the given nominal voltage, the potentiostat amplifies this small deviation and regulates the current flowing through the arrangement between the tank and the external current anode 4. This is done in such a way that the voltage maintains its constant value. This fixed predetermined potential ensures constant corrosion protection, prevents the undesired formation of hydrogen to a great extent and regulates the current to the desired level which is required for corrosion protection by the potentiostatic current, so that unnecessary current consumption is avoided.

A potentiostat required for a household hot water tank of about 80 liter capacity consists substantially of a transformer $220/2\times 18$ V, a rectifier and stabilizer unit, consisting of rectifiers, Zener diodes, transistors, capacitors and resistors, a so-called nominal voltage source, a differential and preamplifier preferably having integrated circuit construction and of two transistors as power amplifiers in the output stage. The details of such a potentiostat do not form a part of the present invention and are therefore not described here.

Figure 3:
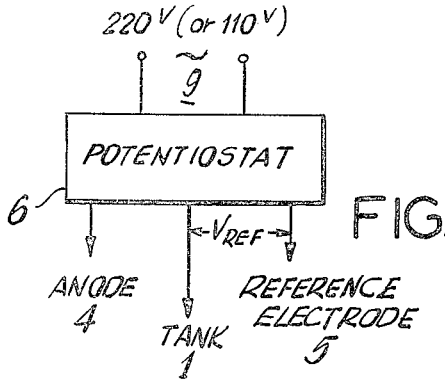
FIG. 3 is a schematic indication of the electrical arrangement among the various elements of the invention.

The electrical interrelationship of the external voltage supply 9, potentiostat 6, external current anode 4, tank 1 and reference electrode 5 is shown in FIG. 3.

In order to be able to maintain the potentiostatic cathodic corrosion protection on hot water tanks filled with fresh water over a long period of time, it is necessary to use a reference electrode which has a practically constant potential in drinking water which also depends little on the temperature. Furthermore, the reference electrode must have a very long service life. Particularly suitable is a silver/silver chloride reference electrode. The latter consists of a silver wire on which a silver chloride layer is applied electro-chemically. This wire dips into a solution with a known chlorine-ion activity. Such an arrangement has a very constant reproducible potential even over long periods of time and has very little temperature dependence. The service life of an Ag/AgCl electrode dipping into water depends among other factors on the solubility of the silver chloride in water. This solubility is relatively low at low temperatures, but increases greatly with temperature. At 60° C. (the working temperature in a standard household hot water tank), it is about $7\times 10^{-3}$ g, per liter. That is, if this electrode is wetted directly with fresh water, the silver chloride would dissolve in a relatively short time and the electrode would become unusable.

For this reason, a reference electrode is used which is provided with a flow-preventing sheathing in such a way that the electrode proper is surrounded by stagnant water so that the silver chloride can dissolve practically only by diffusion. For example, referring to FIG. 4*a*, a silver rod coated with silver chloride can be arranged in a plastic sheathing 10 with an inside diameter of about 1 cm, which has so many openings 11 of about 3 mm diameter that the entire hole cross section is about 1 $cm^2$. As an additional flow-preventing measure, the plastic sheathing provided with openings can again be surrounded by a plastic tube, open at one end, with a closed surface. The entire arrangement can be screwed into the hot water tank.

Calculations show that in this case, with a diffusion cross section of 1 $cm^2$ and a diffusion path of 1 cm, and with an assumed diffusion coefficient of $10^{-4}$ $cm^2$/sec for silver chloride, only about 30–50 mg silver chloride would be dissolved in about 10 years. Since the amount of silver chloride deposited on the silver wire is about 1 g, this ensures a sufficient service life for such an electrode under the indicated conditions.

Naturally the above described embodiment can be modified in many ways without departing from the basic idea of the invention. Thus, for example, an additional external current anode could be provided in the upper region of the tank, as mentioned above, which is controlled by way of the same reference electrode and the same potentiostat. This has the advantage that an even more uniform potential can be set over the entire tank.

Figure 5:
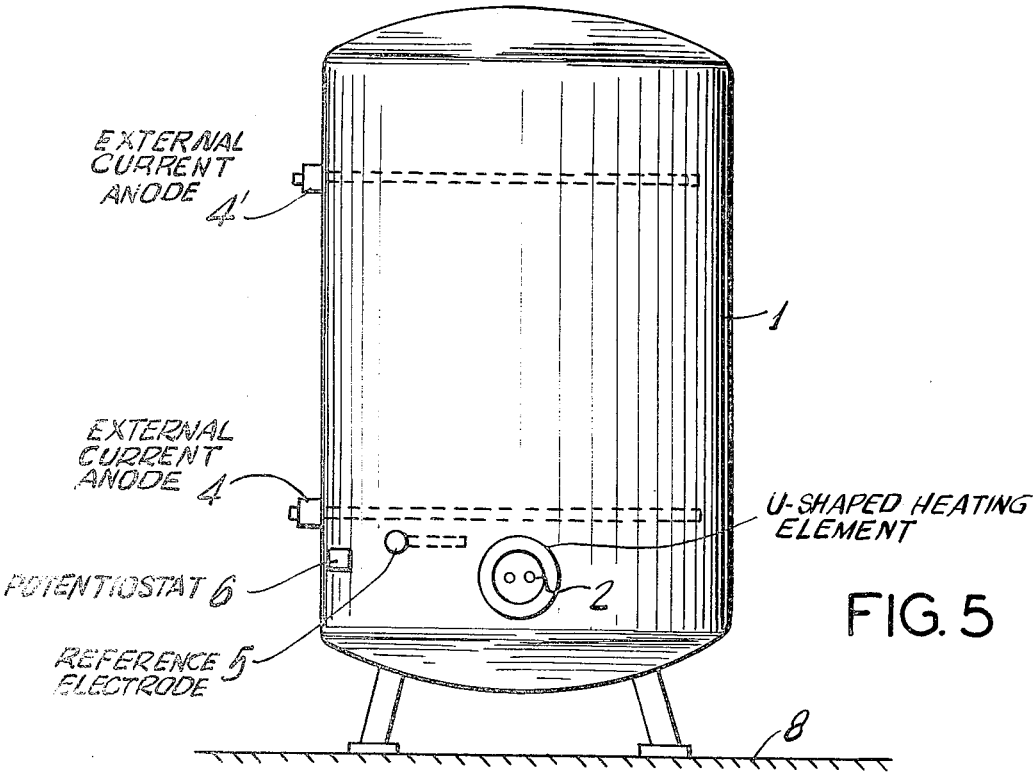
FIG. 5 illustrates an embodiment of the present invention indicating a second external current anode in an upper part of the tank.

FIG. 5 shows such an arrangement where the additional external current anode 4' is shown disposed in the upper portion of the tank 1.

As has been shown and described above, the present invention provides a design and arrangement by which even relatively small hot water tanks can be so regulated potentiostatically and be protected with relatively little expenditure, contrary to expectation. As soon as a defective spot appears in the passive anticorrosion layer during the operation of the tank, the protective current increases automatically and adjusts itself to the new situation. The direct correlation between the external current anode and the heating element neutralizes to a great extent the action of the heating element as a cathodic region, so that the oxygen separation is compensated in this region and the defective spots in the passive anticorrosive layer appearing in this region are no longer jeopardized.

There was some fear, which does not exist in exposed surfaces like hulls and pipe lines, that because of the formation of hydrogen, particularly on the heating element, and because of the formation of oxygen on an anode supplied with external current, the danger of oxyhydrogen gas would be increased. The setting of an optimum potential according to the invention, even further reduces the formation of hydrogen in the tank than in a tank protected by a magnesium donor anode. Accordingly, instead of the dreaded oxyhydrogen hazard, this hazard is actually reduced by the use of an external current anode according to the invention.

A particularly advantageous design has been described by the provision of a substantially U-shaped electric heating element extending horizontally in the lower region of the tank, when the external current anode is arranged above the U-shaped heating element perpendicular to its arms.

An even more uniform potential as has been described, can be set in the entire tank if an external current anode is also arranged in the upper region of the tank which is controlled over the same reference electrode and the same potentiostat.

If a reference electrode of Ag/AgCl is used, it is of advantage to surround the reference electrode with a flow-preventing sheathing in order to prevent the silver chloride from dissolving in a relatively short time so that the electrode becomes unusable, which happens particularly when the electrode is surrounded by flowing fresh water. Thus, if the electrode is surrounded according to the measure suggested by the invention by stagnant water, the silver chloride can practically only be dissolved by diffusion, which ensures a much longer service life.

Figure 4A:
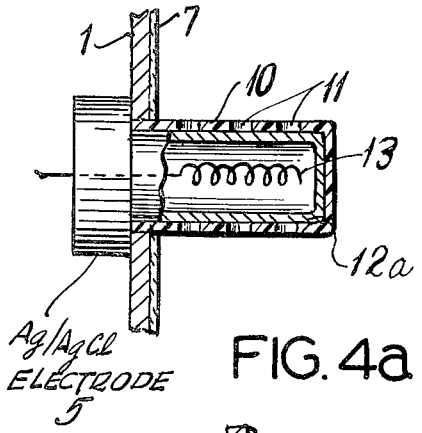
FIGS. 4*a*, 4*b* and 4*c* indicate in cross-section, three embodiments for a reference electrode having a protective sheath.
Figure 4B:
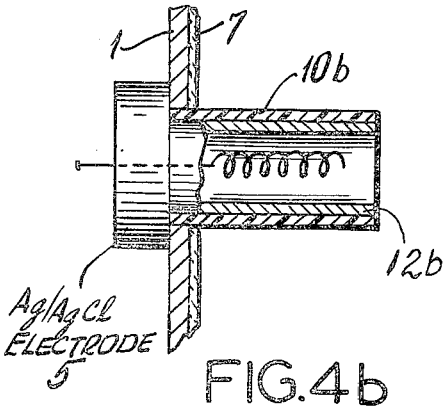
Figure 4C:
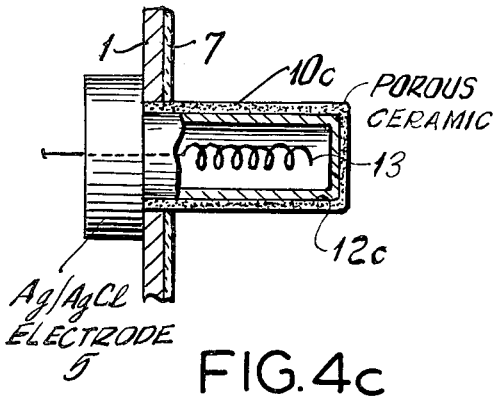

FIGS. 4*a*, 4*b* and 4*c* illustrate a construction of a reference electrode wherein sheathing is provided in the form of a tube for prolonging the life of an Ag-/AgCl reference electrode. In FIG. 4*a*, the sheathing 10 is closed around the electrode but has openings 11 to allow the water to reach the electrode. Element 12*a* is the extension of the electrode and 13 is the electrical arrangement in schematic form. In FIG. 4*b*, the electrode is covered by a sheathing 10*b* in part but has an open end face. Element 12*b* is again the extension of the electrode. In FIG. 4*c*, the electrode is again covered by a sheathing 10*c* but the sheathing is porous, such as a porous ceramic material. Here, element 12*c* is the electrode extension.

While the foregoing description and drawings represent the preferred embodiments of the present invention, it will be obvious to those skilled in the art that various changes and modifications may be made therein without departing from the true spirit and scope of the present invention.

What is claimed is:

1. An improved anticorrosion protected small electric household water heating tank, comprising:

a metallic household water heating tank having a passive anticorrosive layer provided on an inner wall thereof;

an electric immersion heating element arranged horizontally in a lower region of the tank;

a pair of electrodes supplied with external current for providing cathodic corrosion protection, one of said electrodes being an external current anode arranged substantially at the level of the heating element and extending within said tank, the other electrode being said tank itself;

a reference electrode affixed to a wall of said tank and extending within the lower region of said tank;

electrical power source means; and a potentiostat, said potentiostat including means connected to the reference electrode and tank for detecting the potential between the reference electrode and tank, means for comparing the detected potential between tank and reference electrode to a reference voltage and means responsive to a deviation between the detected potential and the reference voltage for adjusting the current flow to the external electrodes from the power source means to maintain an optimum potential between the tank and reference electrode;

wherein said electric heating element is substantially U-shaped and wherein the external current anode is arranged horizontally above the U-shaped heating element and perpendicular to the arms of the U-shaped element.

2. The improved corrosion protected household water heating tank according to claim 1 wherein an additional external current anode is arranged horizontally in the upper region of the tank, the current through said additional external current anode also being controlled by said potentiostat, said upper region of said tank being free of any electric heating elements.

3. The improved corrosion protected household water heating tank according to claim 1 wherein the reference electrode is of Ag/AgCl and is surrounded by a flow-preventing sheathing which creates a zone of stagnant water about the reference electrode.

4. The improved corrosion protected household water heating tank according to claim 3 wherein the sheathing is formed by a tube open at one end and having a closed peripheral surface.

5. The improved corrosion protected household water heating tank according to claim 3 wherein the sheathing is formed by a tubular porous jacket which is closed at one end.

* * * * *